United States Patent [19]

Miyazaki et al.

[11] Patent Number: 4,539,453

[45] Date of Patent: Sep. 3, 1985

[54] CONTROL CIRCUIT FOR A MICROWAVE OVEN

[75] Inventors: Koichi Miyazaki, Shizuoka; Masayuki Aoki, Nagoya, both of Japan

[73] Assignee: Kabushiki Kaisha Toshiba, Tokyo, Japan

[21] Appl. No.: 597,424

[22] Filed: Apr. 6, 1984

[30] Foreign Application Priority Data

Jun. 10, 1983 [JP] Japan ..... 58-103654

[51] Int. Cl.[3] ..... H05B 6/68

[52] U.S. Cl. ..... 219/10.55 C; 219/10.55 B; 219/10.55 M; 126/197; 307/142; 340/655

[58] Field of Search ..... 219/10.55 C, 10.55 B, 219/10.55 D, 10.55 R, 10.55 M, 489; 126/197, 190; 307/142, 126, 116, 96, 97; 340/654, 655, 652

[56] References Cited

U.S. PATENT DOCUMENTS 4,232,210 11/1980 Oida et al. ..... 219/10.55 C
4,415,887 11/1983 Kawase ..... 219/10.55 C X
4,425,490 1/1984 Takeda et al. ..... 219/10.55 B
4,464,553 8/1984 Ikeda ..... 307/97 X

FOREIGN PATENT DOCUMENTS 54-38307 11/1979 Japan .

*Primary Examiner*—Philip H. Leung
*Attorney, Agent, or Firm*—Schwartz, Jeffery, Schwaab, Mack, Blumemthal & Evans

[57] ABSTRACT

A control circuit for a microwave oven with a mechanical switch locking assembly, wherein a cooking start switch is available to turn on after closing a door and is turned off when the door is opened. The control circuit includes a relay for connecting a power source to energize a magnetron, and control means for controlling the relay. The control means enables the relay to connect the power source with the magnetron when the cooking start switch is turned on after connecting the control means with the power source. If the cooking start switch is already turned on prior to connecting the microwave oven to the power source, the operator must first open the microwave oven door, thus opening the start switch, and subsequently closing the door and closing the start switch. This safety procedure encourages the operator to insure that food products are placed in the oven, thus reducing the danger of operating the oven without a load.

9 Claims, 4 Drawing Figures

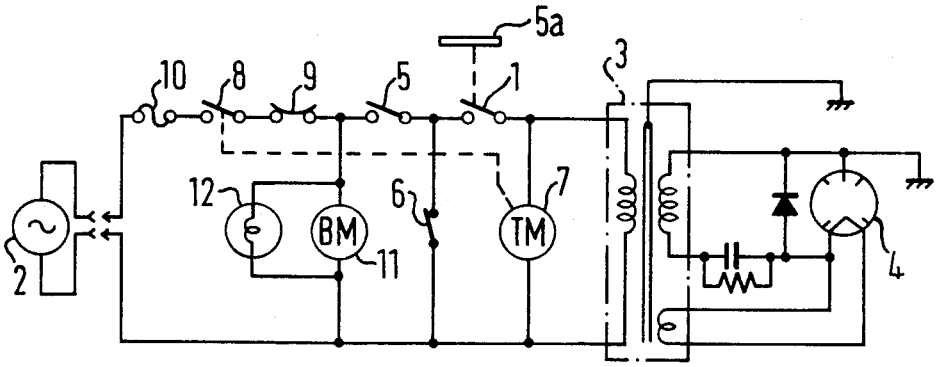
FIG. 1
(PRIOR ART)
FIG. 2
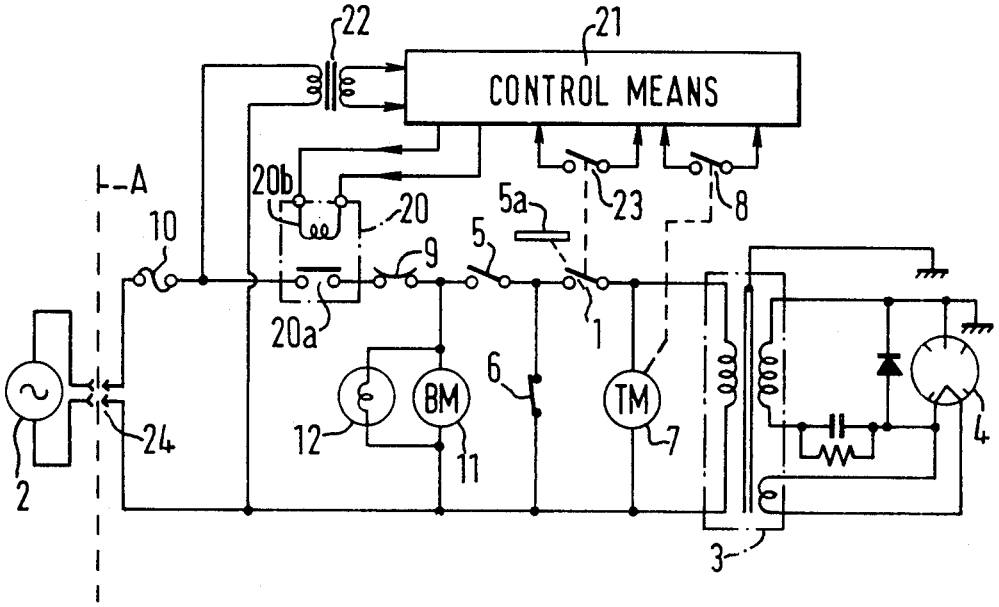

CONTROL CIRCUIT FOR A MICROWAVE OVEN

BACKGROUND OF THE INVENTION

This invention relates to a microwave oven with a mechanical locking assembly, and in particular to a control circuit for the microwave oven.

A conventional microwave oven has a mechanical switch locking assembly, which permits operation of the microwave oven via the start switch only when the door is closed. This type of the microwave oven is shown, for example, in Japanese Utility Model No. Sho 54-38307 published on Nov. 14, 1979, incorporated herein by reference.

FIG. 1 shows a control circuit of the microwave oven with the mechanical locking assembly of the prior art. As shown in FIG. 1, a cooking start switch 1 is provided between a power source 2 and a high voltage transformer 3. The transformer 3 produces a high operating voltage for magnetron 4. The cooking start switch 1 is operated in response to depression of a cooking start button (not shown) and is turned on mechanically in the mechanical locking assembly which includes the door latching assembly. Namely, cooking start switch 1 turns on when the cooking start button is pushed but only if the microwave door is closed, and the oven is turned off if the door is opened. A door switch 5 and a door lock monitor switch 6 are turned respectively on and off, when the door is closed and locked.

A mechanical timer motor 7 turns a timer switch 8 off after a predetermined cooking time is over. The control circuit further includes additional parts, such as a magnetron thermal switch 9, a fuse 10, a blower motor 11, and a cooking lamp 12.

Accordingly, if the door is closed when food is put into the oven, door switch 5 and door lock monitor switch 6 are respectively locked to an on (closed) and off (open) positions. Timer switch 8 is turned on (closed) when the cooking time is set by a timer setting device (not shown). The cooking start switch 1 may then be turned on to energize the magnetron 4.

The magnetron 4 produces sufficient microwave energy for cooking. If the door is opened during the cooking operation, cooking start switch 1 is turned off, and magnetron 4 is deenergized to cancel the cooking operation. The cooking time does not lapse, since the timer motor 7 is de-energized. If the door is once again closed, the start switch 1 may be turned on to once again energize the magnetron 4 to resume the cooking operation.

However, in the conventional microwave oven with the mechanical locking assembly, if the power source 2 is connected when the cooking start switch 1 is turned on, magnetron 4 is energized directly. Therefore, it may be dangerous to energize magnetron 4 directly as, for example, when there is no food in the oven since there is a danger of fire or sparking due to high energy reflections.

SUMMARY OF THE INVENTION

It is a primary object of the present invention to provide a control circuit for microwave oven, which prevents the magnetron from energizing if there is no food in the oven.

It is another object of the invention to provide a control circuit for a microwave oven, which checks for safety of operation when a power source is supplied for the microwave oven.

It is further object of the invention to provide a microwave oven, which is available for safely cooking food products.

The control circuit for a microwave oven with a mechanical switch locking assembly of the present invention comprises a cooking start switch, relay means provided between a power source and a high voltage transformer for a magnetron, and control means for controlling the relay means according to a signal of the cooking start switch. The control means maintains the relay means off if the cooking start switch is turned on when the power source is supplied for the microwave oven.

BRIEF DESCRIPTION OF THE DRAWINGS

Features of the present invention will be apparent from the following drawings, wherein:

FIG. 1 is a circuit diagram of a conventional control circuit for the microwave oven with the mechanical locking assembly;

FIG. 2 is a circuit diagram of an embodiment of the present invention;

DETAILED DESCRIPTION OF THE PREFERRED EMBODIMENT

Figure 3:
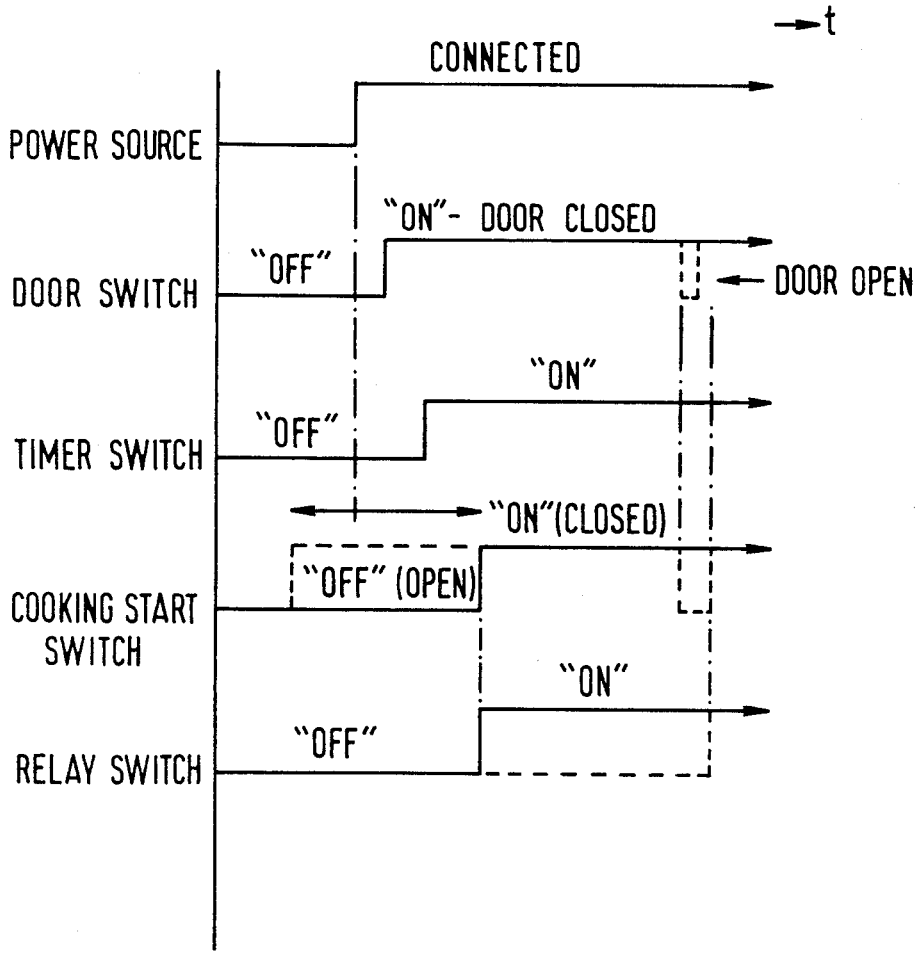
FIG. 3 is a graph showing various switch conditions for describing the operation of the control circuit for the microwave oven.

A preferred embodiment of the invention is shown in FIG. 2, wherein like reference numerals designate like elements as in FIG. 1.

The control circuit for the microwave oven is shown to include the cooking start switch 1 and a relay means 20 between power source 2 and a magnetron energizing means in the form of a high voltage transformer 3. The relay means 20 includes a relay contactor **20*a* and a relay coil 20*b*. Relay contactor 20*a*, door switch 5, and cooking start switch 1 are connected in series to the power source 2 and the high voltage transformer 3. The microwave door, indicated at 5*a*, includes a latching assembly which mechanically interconnects to the start switch 1 as indicated by the dotted line to open the start switch whenever the door 5*a*** is opened. A suitable locking assembly is shown in the above-mentioned Japanese utility model.

The relay coil **20*b* is connected to a control means 21. A transformer 22 is connected to power source 2 through fuse 10, and produces a voltage for the control means 21. Control means 21 also connects with a logic switch 23 and the timer switch 8. The logic switch 23 is turned on (closed position) and off (open position) in response to the cooking start switch 1, and serves to monitor switch 1**.

Control means 21 may comprise a microprocessor or LSI circuit chip operable to perform the various control functions set forth below in reference to FIGS. 2–4. An example of such a microprocessor is the NEC D550C.

The normal operation of the control circuit is explained in reference to FIG. 3. The term control circuit as used herein identifies the circuit components shown in FIG. 2 to the right of the dotted line A, namely, those elements downstream of a power line connector plug 24. Under normal operation, power is first connected to the control circuit, and the operator places the food products to be cooked into the oven and closes the oven door which in turn closes the door switch 5. The operator then sets the timer motor 7 which closes the timer switch 8. The operator finally depresses a start button which closes the cooking start switch 1, which in turn closes the logic switch 23. Control means 21 responds to the closure of logic switch 21 and timer switch 23 to energize relay means 20, thus closing relay contractor 20*a*. Closure of relay contractor provides power to the high voltage transformer thus energizing magnetron 4.

Figure 4:
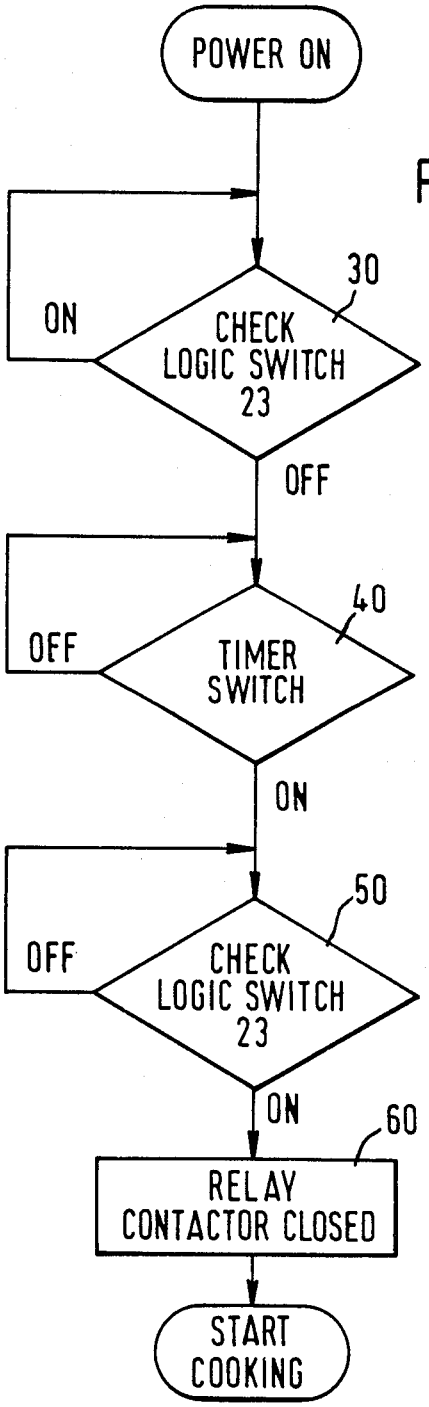
FIG. 4 is a flow chart showing the safety operation mode of the control circuit for the microwave oven.

The operation of the control circuit in its safety mode is illustrated by the dotted lines in FIG. 3 and by the flowchart of FIG. 4. In the safety mode, it may be assumed that the cooking start switch 1 is closed (on) before power is supplied to the control circuit. This sequence of events may occur during a temporary interruption of power or by the operator unplugging the microwave oven while it is operating, i.e., with the start switch closed, and then once again plugging in the oven to reestablish power. It may be assumed that the microwave oven door and thus door switch 5 are closed during the power interruption. With such an interruption of power the reconnecting of the control circuit to the power source will not be effective to energize magnetron 4 since relay contractor 20*a* will be open once the power source is interrupted and will not be closed again until after the oven door is opened and again closed. When the door is opened, the door switch 5 opens and the cooking start switch 1 opens. When the door closes, the door switch 5 closes and the operator may then depress the start button to once again close the cooking start switch 1.

To implement the above-described safety mode of operation, the microprocessor of control means 21 performs the steps illustrated in the flowchart of FIG. 4 with each power-up of the microwave oven. The power-up program governing operation of the microprocessor first proceeds to step 30 to determine if the logic switch 23 is on or off. It will be recalled that the logic switch 23 is directly responsive to the cooking start switch 1 and opens and closes corresponding thereto. If the logic switch 23 is on (switch closed), the program continuously loops to await the turning off of the logic switch 23. Thus, the program does not proceed, and the oven will not operate, until the logic switch 23 turns off in response to the opening of the oven door. It will be recalled that the oven door is mechanically interconnected to automatically open the cooking start switch 1 upon opening of the oven door. Once the logic switch 23 is detected to be off (open), the program proceeds to step 40 where it checks to see if the timer switch 8 is closed. If the timer switch is closed, the program then proceeds to step 50 where the state of logic switch 23 is once again checked. This time the program loops until the logic switch 23 is on, indicating that the cooking start switch 1 has been turned on (closed). Under these circumstances, the operator must have closed the oven door and depressed the start button. After step 50, the program goes to step 60 in which the relay means 20 is energized thus closing relay contractor 20*a*. The magnetron 4 is then energized.

When the predetermined cooking time has elapsed, timer switch 8 opens, and the control means 21 provides a signal to relay means 20 to open relay contractor 20*a*, thus terminating the cooking operation.

In summary, control means 21 checks via logic switch 23 whether the cooking start switch 1 is turned on or not before the microwave oven is connected to the power source. If the switch 1 is already turned on when the power is supplied to the control circuit, control means 21 does not operate to turn on the relay means 20 without the cooking start switch 1 being turned off and then once again turned on. Therefore, even if the operator connects the microwave oven to the power source after shutting the door and turning on the cooking start switch 1, the microwave oven does not start to cook, thus providing the desired safety function.

The present invention encourages the operator to check whether or not there are food products in the oven, by forcing the operator to open the microwave oven door. Thus, the present invention aids in preventing the magnetron from being energized when the oven is empty.

While the invention has been described in reference to a preferred embodiment, it will be understood by those skilled in the art that various modifications may be made without departing from the spirit and scope of the invention as set forth in the appended claim.

What is claimed is:

1. A control circuit for a microwave oven comprising:

(a) a start switch mechanically interconnected to a latching assembly of a microwave oven door, said start switch opening upon opening of said microwave oven door, (b) means for energizing a magnetron of said microwave oven, (c) a relay contactor connected between said energizing means and a power source, said relay contactor closing to connect said power source to said energizing means, and (d) control means responsive to said start switch and operative upon connecting of said power source to said control circuit for determining the state of said start switch and for closing said relay contactor upon determining that said start switch is again closed only if said start switch was previously closed, then opened, and again closed wherein opening of said microwave oven door also opens said start switch, whereby upon power-up of said control means, said microwave oven door must be opened and then reclosed if said start switch is initially closed to encourage an operator of said oven to place food products therein prior to energizing said magnetron megatron of said microwave oven.

2. A control circuit as recited in claim 1 wherein said start switch and said relay contactor are connected in series between said power source and said energizing means.

3. A control circuit as recited in claim 1 wherein said energizing means comprises a high voltage transformer.

4. A control circuit as recited in claim 1 further comprising a timer for controlling the cooking time of operating said microwave oven, said control means further responsive to the setting of said timer for closing said relay contactor only if both said timer is set and said start switch is subsequently closed.

5. A control circuit as recited in claim 1 wherein said control means comprises a microprocessor.

6. A control circuit as recited in claim 5 wherein said microprocessor is programmed to examine the state of said start switch upon each power-up of said microwave oven.

7. A control circuit as recited in claim 1 further comprising a logic switch connected to said microprocessor and responsive to said start switch for opening and closing corresponding thereto, said microprocessor examining the state of said logic switch as an indication of the state of said start switch.

8. A control circuit as recited in claim 1 further comprising a relay coil connected to said control means and responsive thereto for connecting and disconnecting said relay contactor.

9. A method of operating a microwave oven having a start switch mechanically interconnected to a door of said oven to open upon opening of said door, said method for assisting in safely loading said microwave oven prior to energizing a magnetron of said oven comprising the steps of:

(a) upon connecting power to said microwave oven, determining the state of said start switch of said oven, (b) energizing said magnetron of said microwave oven upon first determining that said start switch is closed only if said start switch is subsequently opened and again closed whereby upon power-up of said control means, said microwave oven door must be opened and then reclosed if said start switch is initially closed to encourage an operator of said microwave oven to place food products therein prior to energizing said magnetron of said microwave oven.

* * * * *